US005508879A

United States Patent [19]

Kitamura et al.

[11] Patent Number: 5,508,879

[45] Date of Patent: Apr. 16, 1996

[54] CHARGE REMOVAL BRUSH

[75] Inventors: Masahiko Kitamura; Kiyoshi Chatani; Kazuhiro Yoshihara; Ikuro Sugiyama, all of Kanagawa; Toyohiro Kanzaki, Aichi, all of Japan

[73] Assignees: Fuji Xerox Co., Ltd., Tokyo; Tsuchiya Co., Ltd., Aichi, both of Japan

[21] Appl. No.: 298,556

[22] Filed: Aug. 30, 1994

[30] Foreign Application Priority Data

Aug. 31, 1993 [JP] Japan ..... 5-237241

[51] Int. Cl.[6] ..... H05F 3/02

[52] U.S. Cl. ..... 361/221; 355/219

[58] Field of Search ..... 361/212, 214, 361/220, 221; 355/219

[56] References Cited

U.S. PATENT DOCUMENTS

| | | | |
|---|---|---|---|
| 3,757,164 | 9/1973 | Binkowski | 361/212 |
| 4,352,143 | 9/1982 | Uno | 361/221 |
| 4,455,078 | 6/1984 | Mukai et al. | 361/221 X |
| 4,868,710 | 9/1989 | Powell | 361/212 |
| 5,150,273 | 9/1992 | Le Vantine | 361/221 |

FOREIGN PATENT DOCUMENTS

| | | |
|---|---|---|
| 1-217387 | 8/1989 | Japan . |
| 3-153287 | 7/1991 | Japan . |

*Primary Examiner*—Fritz M. Fleming
*Attorney, Agent, or Firm*—Finnegan, Henderson, Farabow, Garrett & Dunner

[57] ABSTRACT

A charge removal brush with a number of long conductive filamentous elements for removing charges from an object when the charge removal brush comes in contact with the object, is disclosed. The charge removal brush includes a metal shaft rotatable about the axis thereof, a strip-like woven cloth including a base cloth and long conductive filamentous elements uniformly planted in the substantially entire surface of the base cloth, the strip-like woven cloth being spirally wound on the metal shaft with no gap, and a conductive fiber is woven into the base cloth in a state that the conductive fiber runs along the center line of the base cloth, which is extended in the lengthwise direction of the base cloth.

7 Claims, 4 Drawing Sheets

CHARGE REMOVAL BRUSH

BACKGROUND OF THE INVENTION

1. Field of the Invention

The present invention relates to a charge removal brush for removing charges from the transfer drums and papers in a Xerography image forming apparatus, such as a copying machine and a printer, and from residual toner from the photoreceptor in the cleaning unit in the same apparatus.

2. Discussion of the Prior Art

In Xerographic copying machines, for example, a charge removal roll or a charge removal brush is used for removing charges from residual toner in the stage of cleaning the photoreceptor, which follows the image transfer stage where a toner image is transferred to a paper. The same is used for removing charges from the transfer drums and from a paper in a paper transfer path.

In one of the known fur brushes for charge removal, conductive fibers are used for the brush fur, and the conductive fibers are earthed through a metal shaft.

Published Unexamined Japanese Patent Application No. Hei. 1-217387 discloses a cleaning brush for charge removal in which a band-like woven cloth with conductive fibers planted therein is used for the fur brush, and it is wound on a metal shaft.

The cleaning brush not only removes charges of the residual toner from the photoreceptor but also agitates the residual toner. For the brush fur or the long filamentous elements for the brush, the fibers are entirely planted around of the metal shaft. The metal shaft is driven to rotate in a state the tips of the fibers are in contact with the photoreceptor.

Also in the charge removal brushes used for other components and the like, to secure good charge removal capability, it is desirable that the fibers are uniformly planted around the metal shaft, and the metal shaft is driven to rotate.

The known charge removal brush in which the long filamentous elements of the brush fur are planted around the metal shaft suffers from the following problems.

It is difficult to plant the long filamentous elements uniformly around the metal shaft. Further, it is difficult to bring the brush fur or long filamentous elements into contact with the photo receptor in a state that electric resistance between the brush fur and the shaft is small. If the fur brush satisfying those conditions is manufactured with taking the difficulty, the result is to increase cost to manufacture.

In the case of the cleaning brush disclosed in Published Unexamined Japanese Patent Application No. Hei. 1-217387 in which the band-like woven cloth is wound around the metal shaft, the manufacturing of the cleaning brush is easy, but it is difficult to reduce the electrical resistance between the brush fur and the metal shaft and hence to secure a good electrical conduction therebetween. In one of the possible approaches, the base cloth are entirely made of conductive fibers. Coating of the conductive resin is used for bonding them. The approach succeeds in reducing electrical resistance, but fails in reducing the cost to manufacture since the conductive fibers are expensive. To solve this problem, the conductive fibers are used mingled with the lengthwise threads of the base cloth. However, the electric resistance between the brush fur and the metal shaft is large at locations where the lengthwise threads of the woven cloth are not conductive. Further, in this charge removal brush, metal fibers are used for the conductive fibers. The metal fibers are not adapted to the widthwise threads when woven. The long filamentous elements of the brush fur, when woven, are erected in a bifurcated or divided fashion. The result is a nonuniform distribution of the planted long filamentous elements of the fur brush.

SUMMARY OF THE INVENTION

Accordingly, an object of the present invention is to provide a charge removal brush in which the long filamentous elements of the brush fur are planted with a uniform distribution over the surface of the metal shaft and a satisfactory charge removal capability is secured, and its manufacturing is easy and the cost to manufacture is low.

To achieve the above object, there is provided a charge removal brush with a number of long conductive filamentous elements for removing charges from an object when the charge removal brush comes in contact with the object, comprising a metal shaft rotatable about the axis thereof, a band-like woven cloth including a base cloth and long conductive filamentous elements uniformly planted in the substantially entire surface of the base cloth, the band-like woven cloth being spirally wound on the metal shaft with no gap, and a conductive fiber is woven into the base cloth in a state that the conductive fiber runs along the center line of the base cloth, which is extended in the lengthwise direction of the base cloth.

Thus, in the construction of the charge removal brush of the present invention, the band-like woven cloth with long filamentous elements planted therein is wound on the metal shaft. Therefore, the manufacturing of the charge removal brush is easy. Further, the long filamentous elements of the fur brush are electrically connected to the metal shaft through the conductive fiber. Therefore, the charge removal capability of the charge removal brush is further improved when the metal shaft is earthed or connected to a bias voltage.

One conductive fiber woven into the base cloth runs along the center line of the base cloth, which is extended in the lengthwise direction of the base cloth. It is noted here that the conductive fiber is expensive, and the required number of it is one. This feature greatly contributes to reduction of the cost to manufacture the charge removal brush.

This locational feature of the conductive fiber, viz., it lengthwise runs along the center line of the base cloth, reduces the electric resistance in the contact of the long filamentous elements of the fur brush with the conductive fiber, and in the contact of the woven cloth with the conductive fiber.

The object of the present invention may also be achieved by a charge removal brush with a number of long conductive filamentous elements for removing charges from an object when the charge removal brush comes in contact with the object, comprising a metal shaft rotatable about the axis thereof, a band-like woven cloth including a base cloth and long conductive filamentous elements uniformly planted in the substantially entire surface of the base cloth, the band-like woven cloth being spirally wound on the metal shaft with no gap, and a conductive synthetic fiber containing powder carbon is woven into the base cloth in a state that the conductive synthetic fiber runs in the lengthwise direction of the base cloth.

The charge removal brush thus constructed has also an excellent charge removal capability, and its manufacturing is also easy. It is noted further that the conductive fiber woven into the base cloth is a synthetic fiber containing powder carbon. Accordingly, in the charge removal brush, the long filamentous elements or the conductive fibers are uniformly planted with a uniform distribution thereof over the entire surface of the metal shaft.

In the charge removal brush as just mentioned, the conductive synthetic fiber is woven into the base cloth in a state that the conductive synthetic fiber runs along the center line of the base cloth, which is extended in the lengthwise direction of the base cloth.

The charge removal brush thus constructed has also the advantageous features of the easy manufacturing, low cost, uniform distribution of the long filamentous elements planted, and excellent charge removal capability.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENT

Figure 1:
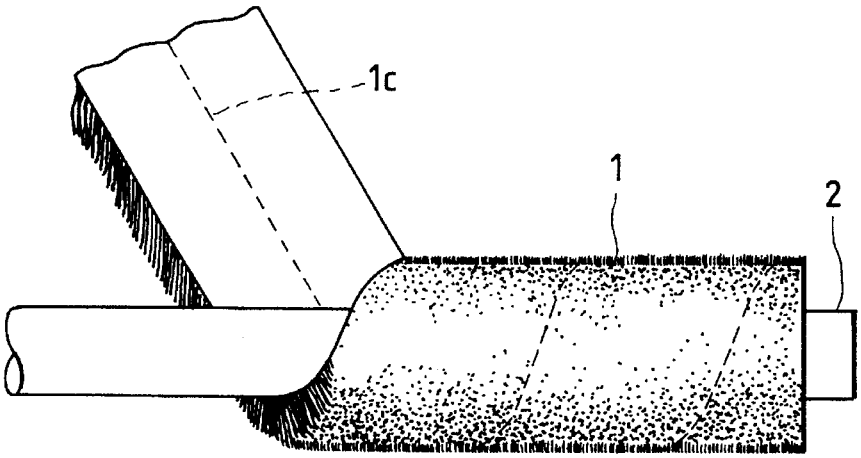
FIG. 1 is a diagram schematically showing a charge removal brush according to an embodiment of the present invention.

The present invention provides a charge removal brush with a number of long conductive filamentous elements for removing charges from an object when the charge removal brush comes in contact with the object. The charge removal brush, as shown in FIG. 1, includes a metal shaft 2 rotatable about the axis thereof, a band-like woven cloth 1 including a base cloth 1*b* and long conductive filamentous elements 1*a* uniformly planted in the substantially entire surface of the base cloth 1*b*, the band-like woven cloth being spirally wound on the metal shaft 1 with no gap, and a conductive fiber 1*c* is woven into the base cloth 1*b* in a state that the conductive fiber 1*c* runs along the center line (indicated by a dotted line in FIG. 1) of the base cloth 1*b*, which is extended in the lengthwise direction of the base cloth 1*b*.

As described above, the charge removal brush of the present invention is formed by spirally winding the band-like woven cloth with long conductive filamentous elements planted therein on the metal shaft. The conductive brush fur is electrically connected to the metal shaft through the conductive fiber, which is woven into the base cloth in a state that the conductive fiber runs along the center line of the base cloth, which is extended in the lengthwise direction of the base cloth. The charge removal capability of the charge removal brush is further improved when the metal shaft is earthed or connected to a proper bias voltage. With this structure, tips of the long filamentous elements of the brush fur come in contact with one another, thereby electrically connecting to the brush fur in the central part thereof. The brush fur in the central part further electrically connects to the conductive fiber, which is woven into the base cloth in a state that the conductive fiber runs along the center line of the base cloth, and finally to the metal shaft. It is noted here that the conductive fiber is located substantially at the center of the base cloth as viewed in the widthwise direction. Because of this, electric resistance among the long filamentous elements of the brush fur is small. When the brush fur comes in contact with an object to be discharged, such as a paper, the transfer drum, or the photoreceptor, electric resistance between the object and the metal shaft is small. The woven cloth is bonded to the metal shaft by conductive adhesive. The conductive fiber is located at the central part of the band-like woven cloth. The part of the woven cloth where the conductive fiber is located is uniformly coated with the adhesive, and bonded to the metal shaft in a state that it is in close contact with the metal shaft. As a result, an excellent conduction is secured, and the electric resistance is further reduced.

The charge removal brush provided according to another aspect of the present invention is also a charge removal brush with a number of long conductive filamentous elements for removing charges from an object when the charge removal brush comes in contact with the object. The charge removal brush, as shown in FIG. 1, includes a metal shaft 2 rotatable about the axis thereof, a band-like woven cloth 1 including a base cloth 1*b* and long conductive filamentous elements 1*a* uniformly planted in the substantially entire surface of the base cloth 1*b*, the band-like woven cloth being spirally wound on the metal shaft 1 with no gap, and a conductive synthetic fiber containing powder carbon is woven into the base cloth in a state that the conductive synthetic fiber runs in the lengthwise direction of the base cloth.

Also in this charge removal brush of the present invention, the long filamentous elements of the fur brush are electrically continuous to the metal shaft. Therefore, it is easy to manufacture the charge removal brush. The conductive fiber woven into the base cloth is the synthetic fiber containing powder carbon. Therefore, the conductive fiber is small in rigidity, or flexible. It is more adaptable for other fibers forming the base cloth. The resultant charge removal brush has uniformly planted long conductive filamentous elements.

This will be described in more detail with reference to FIG. 8. FIG. 8(*a*) is a cross sectional view showing a charge removal brush in which metal fibers are used for the conductive fibers woven into the base cloth of the woven cloth. FIG. 8(*b*) is a cross sectional view showing a charge removal brush in which synthetic fibers containing powder carbon are used for the conductive fibers woven into the base cloth of the woven cloth. FIGS. 8(*c*) and 8(*d*) are side views showing the charge removal brushes shown in FIGS. 8(*a*) and 8(*b*), respectively. FIGS. 8(*e*) and 8(f) are cross sectional views showing the charge removal brushes shown in FIGS. 8(*a*) and 8(*b*), respectively. The woven cloth using the metal fibers is woven such that the widthwise thread is wound about the conductive fibers. For this reason, the long filamentous elements of the fur brush woven into the base cloth, as shown in FIG. 8(*a*), are divided in a bifurcated fashion at the location where the conductive fiber is placed. When the brush fur is wound about the metal shaft, a thin part A of the brush fur is spirally formed as shown in FIGS. 8(*c*) and 8(*e*). On the other hand, in the fur brush in which the synthetic fibers containing powder carbon are woven into the base cloth, the long filamentous elements of the brush fur are uniformly distributed as shown in FIGS. 8(*d*) and 8(f). Accordingly, the charge removal brush of this type has an excellent charge removal capability.

The conductive synthetic fiber 1*c* in the charge removal brush may be woven into the base cloth in a state that the conductive synthetic fiber runs along the center line (indicated by the dotted line) of the base cloth 1*b*, which is extended in the lengthwise direction of the base cloth.

The charge removal brush based on the this concept of the present invention includes the construction based on the first and second concepts. Hence, the charge removal capability is further improved.

In the charge removal brushes thus constructed, any type of fibers, if they are conductive, may be used for the long filamentous elements of the brush fur. In a case where the charge removal brush of the present invention is used for the cleaning brush, a certain measure of rigidity is additionally required for those long conductive filamentous elements. For this reason, long filamentous elements are preferably fiber-contained threads containing fibers made of polypropylene, for example, which has a rigidity high enough for the brush fur, and complex fibers made of nylon or polyester and conductive material, for example, carbon.

The number of the conductive fibers woven into the woven cloth is not limited to a specific number. The present invention is operable even if a single conductive fiber is used.

The charge removal brush thus constructed is capable of effectively removing charges from recording papers and the image transfer drums in the image forming apparatus. When it is applied to the cleaning brush, it can scrape the residual toner from the photoreceptor while removing charges from the residual toner. Accordingly, an efficient cleaning operation is secured. In the charge removal brush in which the fur brush suffers from a nonuniformity part in the distribution of the planted long filamentous elements thereof, the surface of the photoreceptor is damaged when the nonuniformity part of the long filamentous elements is repeatedly brought into contact with the surface of the photo receptor. On the other hand, in the charge removal brush of the present invention, the long filamentous elements of the fur brush are uniformly planted. Accordingly, the charge removal brush of the invention is free from such a problem of damaging the photoreceptor surface.

The preferred embodiment of the present invention will be described with reference to the accompanying drawings.

FIG. 1 is a diagram schematically showing an embodiment of a charge removal brush according to the present invention.

The charge removal brush of the invention includes a strip-like woven cloth with fur planted therein, which is spirally wound on a metal shaft without any space.

Figure 2:
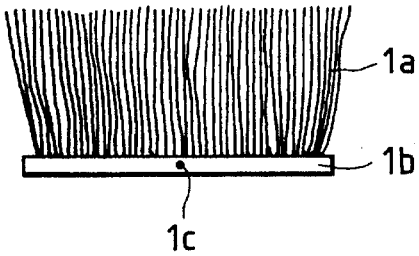
FIG. 2 is a cross sectional view schematically showing a woven cloth used in the charge removal brush shown in FIG. 1.
Figure 3:
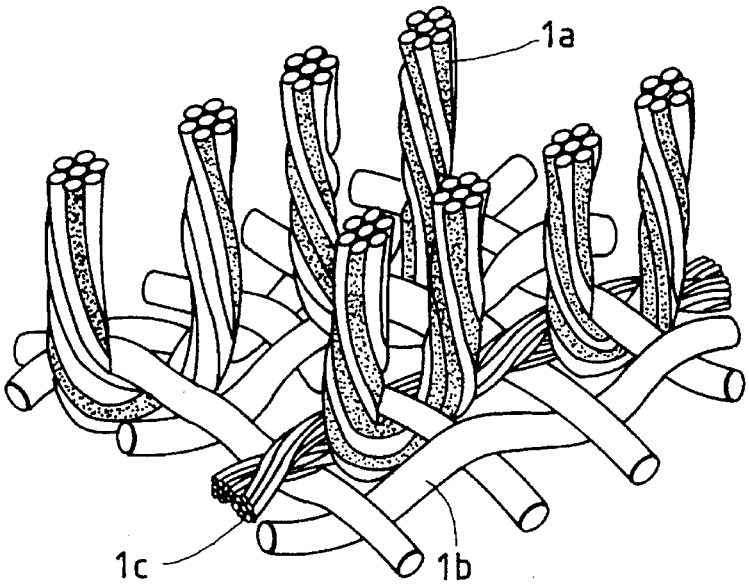
FIG. 3 is a diagram showing a part of the structure of the woven cloth shown in FIG. 2.

FIG. 2 is a cross sectional view schematically showing a woven fabric used for the charge removal brush shown in Fig. 1. FIG. 3 is a diagram showing fibers forming the woven cloth shown in FIG. 2.

The woven cloth includes a base cloth 1*b* woven by warp and weft, and long filamentous elements 1*a* of the brush fur woven into the base cloth 1*b*. A single conductive fiber 1*c* is woven into the base cloth 1*b* in a state that it runs along the center line of the base cloth 1*b*, which is extended in the lengthwise direction of the base cloth.

For the brush fur 1*a*, fiber-contained threads are used, which contain conductive fibers (320 denier and 32 filament) formed by mixing powder carbon into nylon 12, and polyproplylene (170D20F). To form the fibers, nylon 12 and powder carbon are mixed at 10:1 in weight ratio. Electric resistance of 1 filament is $1\times10^6$ to $1\times10^7$ Ω/cm.

If required, complex fibers, such as polyester containing conductive material, may be used for the conductive fibers. The polyproplylene may be replaced by another material having equivalent rigidity. The fiber-contained threads may be replaced by threads containing one kind of filaments if their rigidity and conductivity are comparable with those of the fiber-contained threads.

For the base cloth 1*b*, the warp and weft are both made of polyester fibers. One conductive fiber 1*c* is woven into the center line of the base cloth 1*b*, which is extended in the lengthwise direction of the base cloth. This conductive fiber is made of nylon 12 containing powder carbon (nylon 12: powder carbon=10:1 in weight ratio), like the conductive fibers used for the brush fur. The conductive fiber 1*c* is formed by twisting a pair of threads 320D32F into a single thread.

The charge removal brush of the present invention may be manufactured in the following manner.

A pile is woven by using a general loom of the shuttle type or the shuttle type. At this time, one of the lengthwise threads of the base cloth is used as the conductive fiber, while the pile threads are used as the fiber-contained threads containing the conductive fibers and polypropylene fibers. The weaving is carried out in a state that two sheets of woven cloth are layered one on the other while being connected together by pile threads. After the weaving process, the pile threads are cut. In this way, two sheets of brush fur are produced through one weaving operation. Thereafter, the woven cloth thus formed is cut in proper size, coated with hot melt adhesive, and spirally wound around a metal shaft with no gap. The resultant structure is heated to bond the woven cloth on the metal shaft.

To ensure a good adhesiveness of the adhesive without deteriorating the conductivity of the brush, a proper amount of conductive material, e.g., carbon, is contained in the adhesive, which is hot melt adhesive in this embodiment.

An example of the application of the charge removal brush thus constructed according to the present invention will be described with reference to FIGS. 4 and 5.

Figure 4:
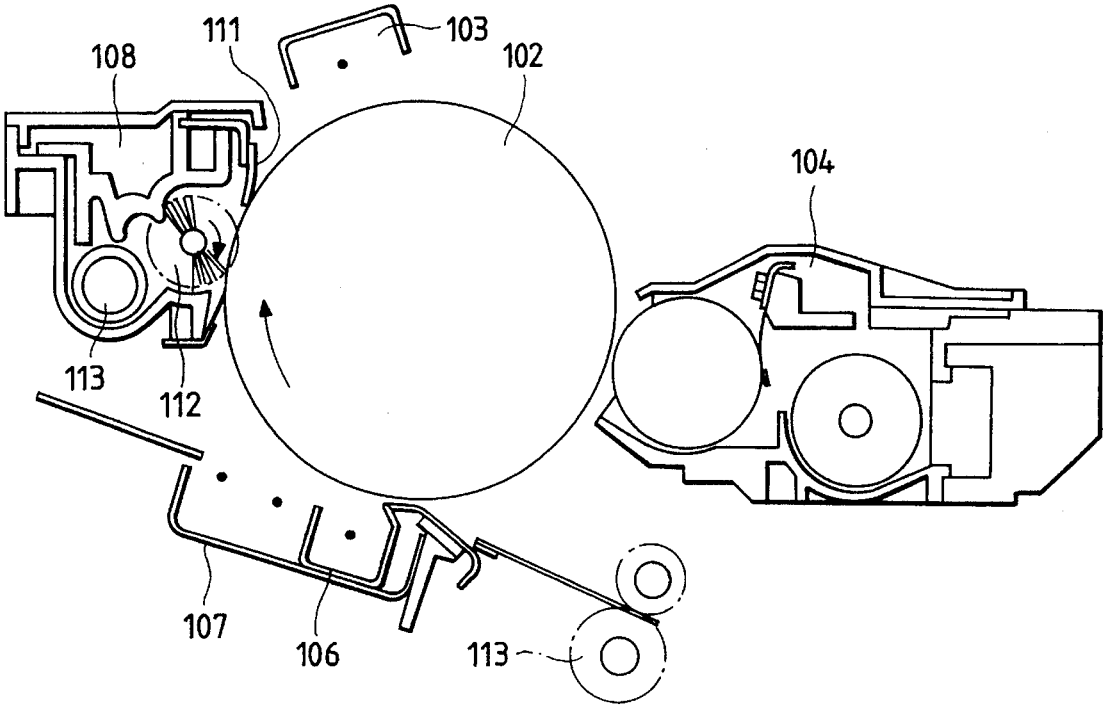
FIG. 4 is a view schematically showing the construction of a cleaning unit using a charge removal brush according to the present invention.

FIG. 4 is a view schematically showing an example of a cleaning unit using the charge removal brush constructed according to the present invention. FIG. 5 is a view schematically showing an example of an image forming apparatus using the cleaning unit shown in FIG. 4.

Figure 5:
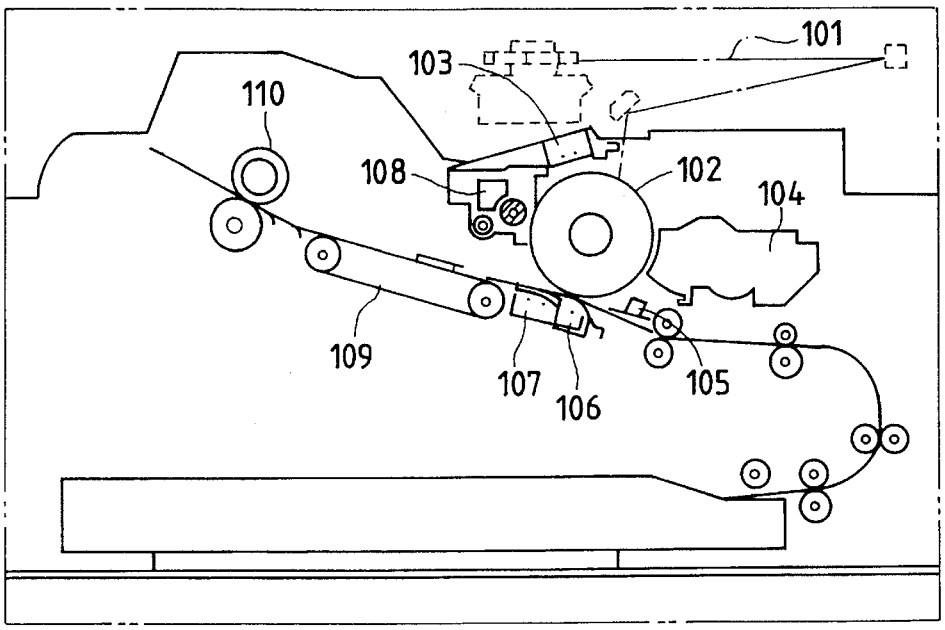
FIG. 5 is a view schematically showing the construction of an image forming apparatus using the cleaning unit shown in FIG. 4.

The image forming apparatus shown in FIG. 5 includes a photoreceptor 102 which is uniformly charged and exposed to an image information contained laser beam 101 emitted from a laser beam generator, thereby forming a latent electrostatic image thereon. The photoreceptor 102 is surrounded by a developing unit 104, a charger 103 for uniformly charging the surface of the photoreceptor 102, the charger 103 being disposed upstream of the developing unit 104 in the rotating direction of the photoreceptor 102, a transfer charger 106 for transferring a toner image from the surface of the photoreceptor onto a paper guided by a paper guide, a separation charger 107 for separating the paper bearing the transferred toner image thereon from the photoreceptor 102, a transfer belt 109 for transporting the separated paper, and a cleaning unit 108 for removing residual toner on the photoreceptor 102.

The photoreceptor 102 is uniformly charged by the charger 103, and exposed to a laser beam 101 from the laser beam generator. As a result, a latent electrostatic image is formed at a preset location on the surface of the photoreceptor 102. The latent image is developed by the developing unit 104. In the process of writing an image in an image area on the surface of the photoreceptor with the laser beam, toner charged in the same polarity as that of the surface potential of the photoreceptor 102 is attracted to the area exposed to the laser beam.

The toner image thus formed is transferred onto a paper coming in from the paper guide, by the transfer charger 106.

After the image transfer process, the paper is discharged by the separation charger 107 and separated from the photoreceptor 102. The paper thus separated is transported by a transfer belt 114 to a fixing unit 110 where it is processed for image fixing.

After the transfer process, the toner left on the photoreceptor 102 is removed by the cleaning unit 108. Then, the above image forming process is repeated.

The cleaning unit 108 includes a cleaning blade 111, a cleaning brush 112, and a toner transporter 113. The metal shaft of the cleaning brush 112 is earthed. The charge removal brush of the invention is used for the cleaning brush 112. As recalled, the charge removal brush includes a conductive brush fur, a woven cloth consisting of a base cloth with a conductive fiber woven thereinto, and a metal shaft.

In the image forming apparatus with such a cleaning unit, residual toner and paper powder let on the surface of the photoreceptor 102 after the transfer process come in contact with the cleaning brush 112, which is rotating in the direction reverse to the rotating direction of the photoreceptor 102. As a result, these are discharged and agitated by the brush. Thereafter, those are scraped off the photoreceptor 102 by the cleaning blade 111, transported by a cleaning brush 112 to a toner transporter 113, and are collected for reuse.

The brush fur of the cleaning brush 112 is conductive and earthed through the metal shaft. With this, when toner and paper powder come in contact with the tips of the brush fur, toner and paper powder are easily discharged to ground through the metal shaft. Accordingly, the residual toner and paper particles left on the photoreceptor 102 can easily be scraped off by the cleaning blade 111. In other words, the photoreceptor 102 can be cleaned without any influence by the charges of the residual materials thereon.

The discharging of the residual materials on the photoreceptor is realized by electrically earthing the cleaning brush, more exactly, the metal shaft, in the above-mentioned embodiment. The same may be realized by applying a bias voltage to the metal shaft. In this case, an electric field is developed between the tips of the brush fur and the photoreceptor. Because of this, the residual materials, such as toner, can be not only mechanically removed with the brush fur, but also removed while electrically attracting the residual materials. The cleaning unit based on this discharging means has an excellent capability of discharging and removing the residual materials on the photoreceptor.

Another application of the charge removal brush of the invention will be described with reference to FIG. 6.

Figure 6:
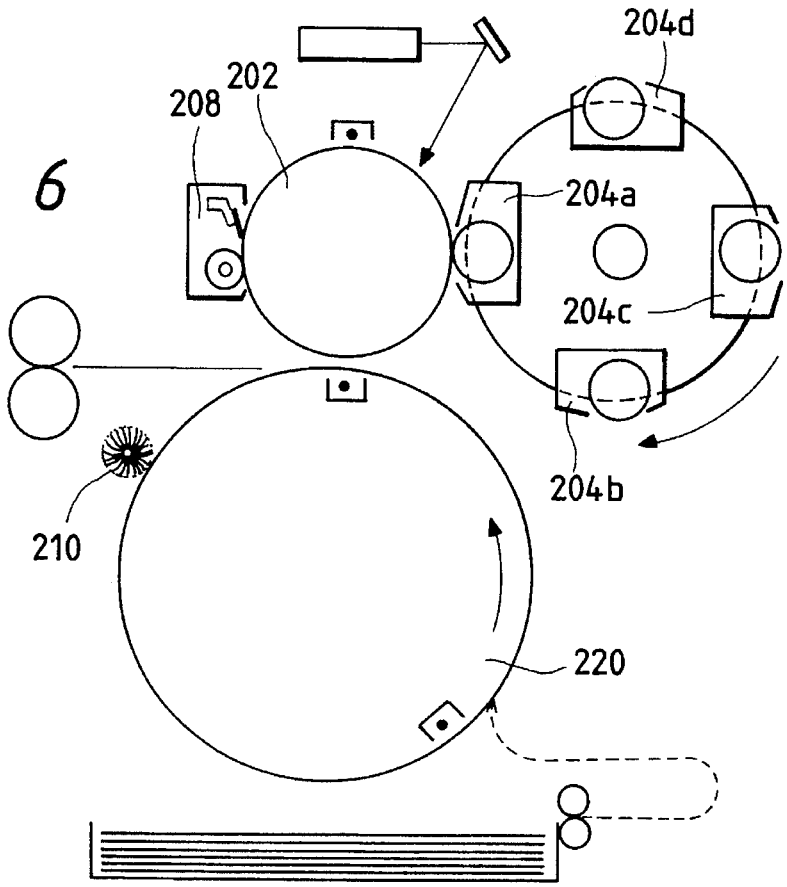
FIG. 6 is a view schematically showing an image forming apparatus in which a charge removal brush of the invention is used for a charge removal means in the transfer drum.

FIG. 6 is a view schematically showing a multi-color image forming apparatus of the type in which toner images of different colors are transferred to a paper in a superposed manner. In the image forming apparatus, the charge removal brush of the invention is used for a charge removal means or charge removal brush 210 in the transfer drum 220.

The multi-color image forming apparatus includes a photoreceptor 202, four developing units 204*a* to 204*d* disposed adjacent to the photoreceptor 202, and a transfer drum 220 disposed facing the photoreceptor 202. The transfer drum 220 rotates carrying a paper thereon.

In the multi-color image forming apparatus, the photoreceptor 202 is exposed to a laser beam containing image information emitted from the laser beam generator, so that a latent image of the first color is formed on the photoreceptor 202. The latent image is developed by a first developing unit 204*a*. The developed image is transferred on a paper electrostatically retained on the transfer drum 220. Subsequently, the latent images of second, third, and fourth colors are developed and transferred onto the paper in successive order, while at the same time the transfer drum 220 is turned carrying the paper thereon. In this way, a toner image of four colors are superposedly transferred on the paper.

Thereafter, the paper is separated from the transfer drum 220 and transported to the fixing unit. The charge left on the surface of the transfer drum is removed by the charge removal brush 210. The residual toner on the photoreceptor 202 is removed by a cleaning unit 208. Then, the photoreceptor 202 is subjected to the next developing process.

After the paper is peeled off the transfer drum 220, the transfer drum 220 is discharged by the charge removal brush. Accordingly, the transfer drum 220 can reliably carry another paper in the next image forming process, ensuring a reliable transfer of the toner images thereto.

Figure 7:
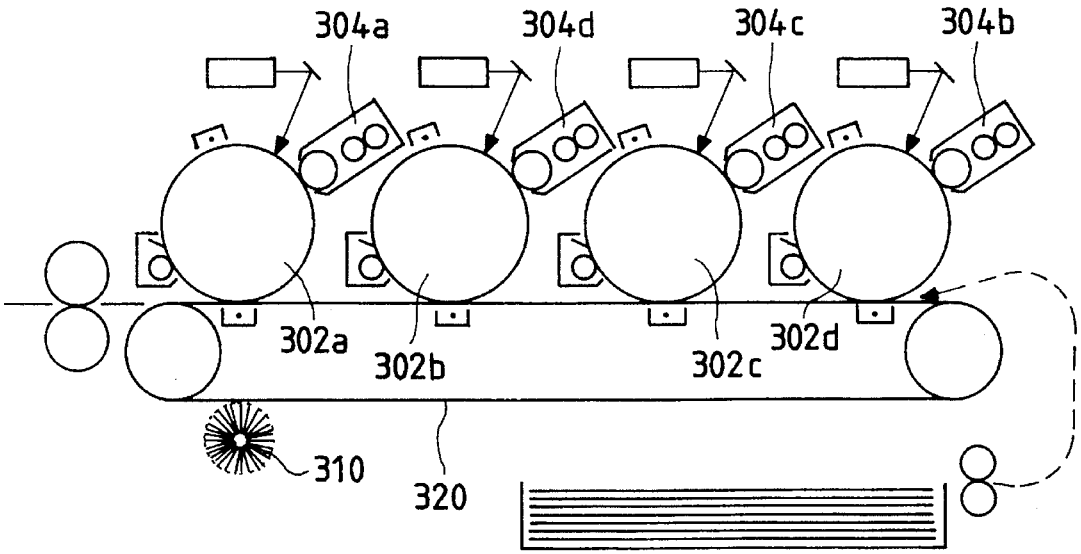
FIG. 7 is a view showing an image forming apparatus in which a charge removal brush of the invention is used for a charge removal means in the paper transport path.
Figure 8A:
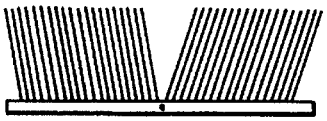
FIGS. 8(*a*)–8(*f*) are explanatory diagrams for explaining the operation and effects of the present invention.
Figure 8B:
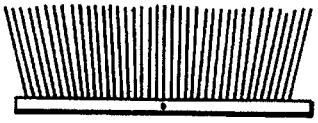
Figure 8C:
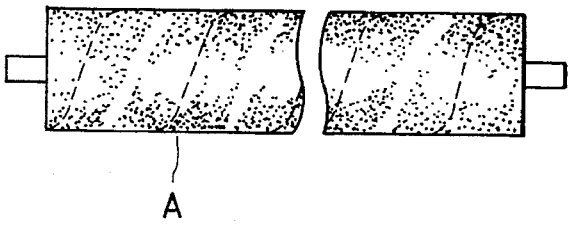
Figure 8D:
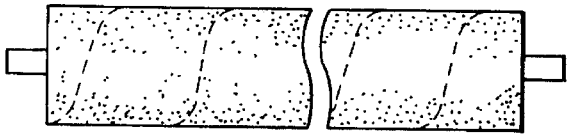
Figure 8E:
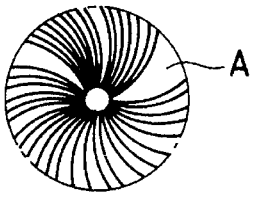
Figure 8F:
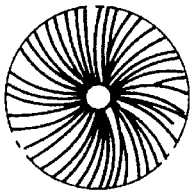

FIG. 7 is a view showing a multi-color image forming apparatus in which a charge removal brush of the invention is used for a charge removal means in the paper transport path. In the image forming apparatus, four photoreceptors 302*a* to 302*d* and four developing units 304*a* to 304*d* are provided for the toner colors, respectively. Toner images formed by these combinations of the photoreceptors and the developing units are superposedly transferred onto a paper. A charge removal brush of the invention is used for a charge removal means of a paper transport belt 320.

In the image forming apparatus, the paper transport belt 320 transports a paper to a location facing the first photoreceptor 302*a*. The first developing unit 304*a* transfers a toner image of the first color from the first photoreceptor 302*a* to the paper. Thereafter, the paper transport belt 320 transports the paper to a location facing the second photoreceptor 302*b*. The second developing unit 304*b* transfers a toner image of the second color from the second photoreceptor 302*b* to the paper. Subsequently, toner images of the third and fourth colors are transferred onto the paper in similar ways.

The paper is transported to a fixing unit, and the paper transport belt 320 is discharged by the charge removal brush 310. Charge is left on the paper transport belt 320 since it passes the locations facing the transfer units and the photoreceptors. However, the paper transport belt 320 is brought into contact with the charge removal brush 310, so that the residual toner thereon is removed. It is ready for the next image forming process.

The foregoing description of preferred embodiments of the invention have been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A charge removal brush with a number of conductive filamentous elements for removing charges from an object when the charge removal brush comes in contact with the object, comprising:

a rotatable metal shaft;

an elongated strip of woven cloth, with a longitudinal center line, and including a base cloth and conductive filamentous elements uniformly planted throughout said base cloth, said strip and woven cloth being spirally wound on said metal shaft with no gap; and a conductive fiber woven into said base cloth such that said conductive fiber runs along the center line of said base cloth.

2. A charge removal brush according to claim 1, wherein said filamentous elements contain, fibers made of polypropylene, and complex fibers made of nylon and conductive material.

3. A charge removal brush according to claim 2, wherein said conductive material is carbon.

4. A charge removal brush according to claim 1, wherein said filamentous elements contain, fibers made of polypropylene, and complex fibers made of polyester and conductive material.

5. A charge removal brush according to claim 4, wherein said conductive material is carbon.

6. A charge removal brush with a number of conductive filamentous elements for removing charges from an object when the charge removal brush comes in contact with the object, comprising:

a rotatable metal shaft;

an elongated strip of woven cloth including a base cloth and conductive filamentous elements uniformly planted throughout said base cloth, said strip of woven cloth being spirally wound on said metal shaft with no gap; and a conductive synthetic fiber containing powdered carbon woven into said base cloth such that the conductive synthetic fiber runs lengthwise along said base cloth.

7. A charge removal brush according to claim 6, wherein said conductive synthetic fiber runs along a center line of said base cloth.

* * * * *